US011414847B2

(12) United States Patent
Junge

(10) Patent No.: US 11,414,847 B2
(45) Date of Patent: Aug. 16, 2022

(54) UNDER SINK WATER DISPENSING SYSTEM

(71) Applicant: Haier US Appliance Solutions, Inc., Wilmington, DE (US)

(72) Inventor: Brent Alden Junge, Evansville, IN (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 118 days.

(21) Appl. No.: 16/915,079

(22) Filed: Jun. 29, 2020

(65) Prior Publication Data

US 2021/0404155 A1 Dec. 30, 2021

(51) Int. Cl.
*E03C 1/044* (2006.01)
*F25B 1/00* (2006.01)

(52) U.S. Cl.
CPC ..... *E03C 1/044* (2013.01); *F25B 1/00* (2013.01); *F25B 2339/047* (2013.01)

(58) Field of Classification Search
CPC ..... F24H 1/00–54; F24H 4/00–04; F24H 7/0233–0241; F24H 7/0433–0441; F25B 1/00; F25B 2339/047; F24D 17/00–02; F24D 17/0026; F24D 19/1054; F24D 19/1072; F24D 2200/12; F24D 2200/123; E03C 1/044
See application file for complete search history.

(56) References Cited

U.S. PATENT DOCUMENTS 2,575,325 A * 11/1951 Ambrose ..... F25B 5/02 62/181
5,956,965 A * 9/1999 Watanabe ..... B01D 5/0042 62/506
6,601,773 B2 * 8/2003 Saitoh ..... F24H 9/2007 165/140
8,001,794 B2 * 8/2011 Windisch ..... F25B 21/02 62/3.5
8,245,949 B2 * 8/2012 McGreevy ..... F24D 17/02 237/19
9,310,113 B2 * 4/2016 Hung ..... B67D 1/0009
2002/0113133 A1 * 8/2002 Saitoh ..... F24H 4/04 237/8 R (Continued)

FOREIGN PATENT DOCUMENTS

CN 102003793 A * 4/2011
CN 201852276 U * 6/2011

(Continued)

*Primary Examiner* — Miguel A Diaz
(74) *Attorney, Agent, or Firm* — Dority & Manning, P.A.

(57) ABSTRACT

A water dispensing system includes a faucet, a sink basin mounted beneath the faucet downstream therefrom, a first storage tank mounted below the sink basin to store a first liquid volume, a second storage tank mounted below the sink basin to store a second liquid volume, and a vapor compression system including a compressor, an evaporator in fluid communication with the compressor, the evaporator being connected to the first storage tank in conductive thermal communication, a condenser in fluid communication with the compressor, the condenser being connected to the second storage tank in conductive thermal communication, and an expansion device in fluid communication with the compressor.

19 Claims, 5 Drawing Sheets

(56) References Cited

U.S. PATENT DOCUMENTS

| | | | | |
|---|---|---|---|---|
| 2011/0203306 | A1* | 8/2011 | Choi | F24H 1/142<br>62/389 |
| 2019/0226735 | A1* | 7/2019 | Bissell | F25B 41/20 |
| 2020/0270850 | A1* | 8/2020 | Kop | F24D 17/0089 |
| 2021/0052106 | A1* | 2/2021 | McKay | F25B 41/20 |

FOREIGN PATENT DOCUMENTS

| | | | | |
|---|---|---|---|---|
| CN | 202581794 | U | * | 12/2012 |
| CN | 102980299 | A | * | 3/2013 |
| CN | 203489467 | U | * | 3/2014 |
| DE | 4417138 | C2 | | 4/1996 |
| EP | 0088055 | A1 | | 9/1983 |
| FR | 2538523 | A3 | * | 6/1984 |
| JP | 2010276254 | A | | 12/2010 |
| KR | 20010112184 | A | | 12/2001 |

* cited by examiner

UNDER SINK WATER DISPENSING SYSTEM

FIELD OF THE INVENTION

The present subject matter relates generally to water dispensing systems, and more particularly to facilitating heat transfer within a self-contained water dispensing system.

BACKGROUND OF THE INVENTION

Water dispensing systems generally produce or dispense chilled drinking water to users for consumption. Household users often desire instantaneous drinking water at chilled temperatures delivered immediately to their sink or faucet. However, problems exist in generating instantaneous chilled water without requiring expensive, elaborate, or cumbersome systems (e.g., which may be too large to mount underneath common household sink basins). Conventional heat transfer systems to produce chilled water rely on large heat exchangers to reject heat to ambient air. Difficulties arise in expelling the heated air. This may be especially true for expelling heated out from under the sink basin after cooling the water. Currently, large and expensive ventilation systems are required to cycle air around the heat exchanger in order to properly disperse the heated air.

Accordingly, further improvements in the field of water dispensing systems would be desirable. In particular, it may be desirable to provide an appliance or system to provide chilled drinking water directly to a kitchen sink or faucet. Furthermore, it may be desirable to provide an appliance or system to provide chilled drinking water without requiring ventilation.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a water dispensing system is provided. The water dispensing system may include a faucet and a sink basin mounted below the faucet. A first storage tank may be mounted below the sink basin to store a first liquid volume upstream from the faucet. A second storage tank may be mounted below the sink basin to store a second liquid volume upstream from the faucet in fluid parallel with the first storage tank. A vapor compression system may be provided and may include a compressor spaced apart from the first storage tank and the second storage tank to motivate a refrigerant along a cooling circuit, an evaporator in fluid communication with the compressor along the cooling circuit, the evaporator being connected to the first storage tank in conductive thermal communication to remove heat from the first liquid volume, a condenser in fluid communication with the compressor along the cooling circuit, the condenser being connected to the second storage tank in conductive thermal communication to transmit heat to the second liquid volume, and an expansion device in fluid communication with the compressor along the cooling circuit.

In another exemplary aspect of the present disclosure, a water dispensing system is provided. The water dispensing system may include a faucet and a sink basin mounted beneath the faucet downstream therefrom. A first storage tank may be mounted below the sink basin to store a first liquid volume upstream from the faucet. A second storage tank may be mounted below the sink basin to store a second liquid volume upstream from the faucet, the second storage tank being in fluid parallel with the first storage tank. A thermoelectric module may be connected between the first storage tank and the second storage tank and may include a first thermally conducting plate attached to the first storage tank to remove heat from the first liquid volume and a second thermally conducting plate attached to the second storage tank to transmit heat to the second liquid volume. A first dispense line may fluidly connect the first storage tank to the faucet, and a second dispense line may fluidly connect the second storage tank to the faucet.

In yet another exemplary aspect of the present disclosure, a method of storing water within a water dispensing system is provided. The method may include transferring heat from a first liquid stored in the first storage tank to a second liquid stored in the second storage tank, measuring a temperature of the second liquid through a temperature sensor, pumping a portion of the second liquid from the second storage tank into a hot water supply when (e.g., in response to) the temperature of the second liquid is/being above a predetermined temperature, and supplying ambient temperature liquid to the second storage tank.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
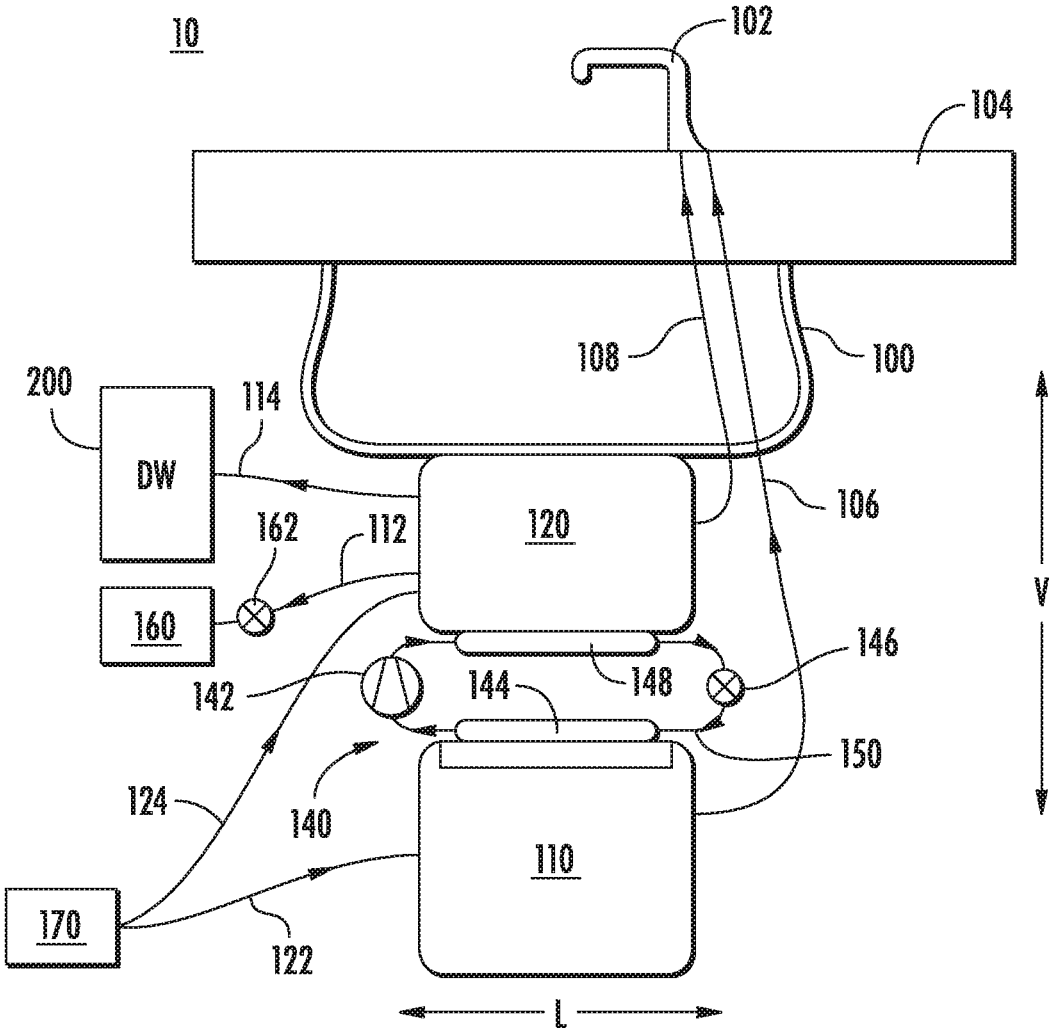
FIG. 1 provides a diagram elevation view of a water dispensing system according to an exemplary embodiment of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the term "or" is generally intended to be inclusive (i.e., "A or B" is intended to mean "A or B or both"). The terms "first," "second," and "third" may be used interchangeably to distinguish one component from another and are not intended to signify location or importance of the individual components. The terms "upstream" and "downstream" refer to the relative flow direction with respect to fluid flow in a fluid pathway. For example, "upstream" refers to the flow direction from which the fluid flows, and "downstream" refers to the flow direction to which the fluid flows. Furthermore, as used herein, terms of approximation, such as "approximately," "substantially," or "about," refer to being within a ten percent margin of error.

Turning now to the figures, FIG. 1 illustrates a diagram elevation view of a water dispensing system 10 according to an exemplary embodiment of the present disclosure. Specifically, referring to FIG. 1, a counter 104 including a sink or sink basin 100 is shown. The counter 104 may be a kitchen counter, a bathroom counter, or the like. In one example, the counter 104 is a household kitchen counter. Sink basin 100 may be mounted in counter 104 (e.g., such that an open volume or cavity extends through or below a bottom surface of counter 104). Sink basin 100 may also be provided on top of counter 104 in some embodiments.

A faucet 102 may be mounted at or adjacent to sink basin 100 (e.g., attached to sink basin 100). The sink basin 100 may be provided downstream from the faucet 102 such that liquid such as water is dispensed from faucet 102 into sink basin 100. Faucet 102 may be a single outlet faucet. For example, a cold water dispense line 106 and a hot water dispense line 108 may be attached to a single outlet such that cold water and hot water can be selectively or alternately dispensed from the single outlet. Alternatively, faucet 102 may have two or more outlets, each outlet dispensing a different temperature (e.g., relative temperature, such as "hot" and "cold") of water. For example, the cold water dispense line 106 may be connected to a drinking water outlet provided within or adjacent to the faucet 102. For another example, the hot water dispense line 108 may be connected to an appliance for brewing or mixing hot water drinks (e.g., coffee, tea, etc.).

A first storage tank 110 may be mounted below the sink basin 100. In some embodiments, the first storage tank 110 is mounted below the counter 104 and below the sink basin 100. Additionally or alternatively, the first storage tank 110 may be mounted adjacent to the sink basin 100. For example, the first storage tank 110 may be adjacent to the sink basin 100 in the lateral direction L or transverse direction T. During use, the first storage tank 110 may store a predetermined volume of a first liquid. For example, the first storage tank 110 may store water to be consumed or used by a user (e.g., after being dispensed from the faucet 102). The first storage tank 110 may store water at a first predetermined temperature. The first predetermined temperature may be between about 35° F. and about 45° F. In one example, the first predetermined temperature is about 38° F. As shown, the first storage tank 110 may be provided upstream from the faucet 102. The cold water dispense line 106 may fluidly connect the first storage tank 110 to the faucet 102. In particular, cold water dispense line 106 may include any number of discrete conduits or pipes connected in fluid series. Accordingly, a desired amount of the first liquid may be supplied from the first storage tank 110 to the faucet 102 via the cold water dispense line 106.

A second storage tank 120 may be mounted below the sink basin 100. In some embodiments, the second storage tank 120 is mounted below the counter 104 and below the sink basin 100. Additionally or alternatively, the second storage tank 120 may be mounted adjacent to the sink basin 100. For example, the second storage tank 120 may be adjacent to the sink basin 100 in the lateral direction L or transverse direction T. The second storage tank 120 may be in fluid parallel with the first storage tank 110. In other words, liquid may be supplied to the faucet 102 independently from the first storage tank 110 and the second storage tank 120. The second storage tank 120 may store a predetermined volume of a second liquid. For example, the second storage tank 120 may store water to be consumed or used by a user. The second storage tank 120 may store water at a second predetermined temperature. The second predetermined temperature may be between about 120° F. and about 140° F. In one example, the second predetermined temperature is about 130° F. The second storage tank 120 may be provided upstream from the faucet 102. The hot water dispense line 108 may fluidly connect the second storage tank 120 to the faucet 102. In particular, hot water dispense line 108 may include any number of discrete conduits or pipes connects in fluid series. Accordingly, a desired amount of the second liquid may be supplied from the second storage tank 120 to the faucet 102 via the hot water dispense line 108.

A feed line 114 may be fluidly attached to the second storage tank 120 (e.g., to supply hot water to a household appliance). In some embodiments, one end of the feed line 114 is fluidly attached to a household appliance opposite the second storage tank 120. The household appliance may be a dishwasher 200, for example, or any other suitable appliance. In the illustrated embodiments, the feed line 114 fluidly connects the second storage tank 120 to the dishwasher 200 to selectively supply hot water to the dishwasher 200, such as during a dishwashing operation.

A hot water return line 112 may be fluidly connected to the second storage tank 120. The hot water return line 112 may fluidly connect the second storage tank 120 to a main hot water line 160. The main hot water line 160 may be downstream from the second storage tank 120. The main hot water line 160 may be a hot water supply that stores and supplies hot water to an entire house. For example, the main hot water line may be a water heater or boiler. Water from the second storage tank 120 may be released to the main hot water line 160 via the hot water return line 112 when (e.g., in response to) a temperature of the water in the second storage tank 120 exceeds/exceeding a preset temperature (e.g., second predetermined temperature), which will be explained in detail below.

According to one example, the hot water return line 112 includes a valve 162. The valve 162 may be any suitable valve to selectively open and close the hot water return line 112 (e.g., a solenoid valve, an adjustable valve, an electronic valve, a ball valve, a gate valve, etc.). The valve 162 may be fluidly connected to the hot water return line 112. In one example, when (e.g., in response to) the temperature of the water in the second storage tank 120 exceeds/exceeding the preset temperature, the valve 162 may be opened to allow at least a portion of the water to be released to the main hot water line 160. For instance, the valve 162 may be opened in response to detecting or measuring a temperature of water in the second storage tank 120 that exceeds the preset temperature. Alternatively or additionally, the hot water return line 112 may include a pump 164 (see FIG. 2). The pump 164 may be any suitable pump to motivate or pump liquid from the second storage tank 120 to the main hot water line 160 (e.g., impeller pump, positive displacement pump, etc.). The hot water return line 112 may be in fluid parallel with the feed line 114 and the hot water dispense line 108.

The water dispensing system 10 may include a vapor compression system 140 to facilitate or direct heat transfer between the first storage tank 110 and the second storage tank 120. The vapor compression system 140 may be provided under the counter 104 or the sink basin 100. For instance, the vapor compression system 140 may be thermally connected to the first storage tank 110 and the second storage tank 120. For instance, a first heat exchanger (e.g., evaporator 144) may be attached to the first storage tank 110 and a second heat exchanger (e.g., condenser 148) may be attached to the second storage tank 120. Thus, the vapor compression system 140 may be wholly contained in a space (e.g., cabinet) below the counter 104.

The vapor compression system 140 may include a compressor 142, an evaporator 144, an expansion device 146, and a condenser 148, as shown. Each of the compressor 142, evaporator 144, expansion device 146, and condenser 148 may be connected by or along a cooling circuit 150. The cooling circuit 150 may be a refrigerant line or pipe through which a refrigerant may be circulated, as would be understood.

The compressor 142 may be spaced apart from the first storage tank 110 and the second storage tank 120 (e.g., to motivate or circulate the refrigerant through the cooling circuit 150). The compressor 142 may be any suitable compressor, for example, a rotary compressor, a reciprocating compressor, a linear screw compressor, an orbiting compressor, or the like may be used.

The evaporator 144 may be in fluid communication with the compressor 142 along the cooling circuit 150. Additionally or alternatively, the evaporator 144 may be connected to the first storage tank 110. In particular, the evaporator 144 may be in thermal communication with the first storage tank 110 to remove heat from the first liquid volume within the first storage tank 110. For example, the evaporator 144 may be in planar contact with a wall of the first storage tank 110 (e.g., with a top wall of the first storage tank 110). Additionally or alternatively, the evaporator 144 may integrally form a wall of the first storage tank 110 (e.g., the top wall of the first storage tank 100). In some embodiments, the evaporator 144 is disposed within the first storage tank 110 (e.g., enclosed therein).

The condenser 148 may be in fluid communication with the compressor 142 along the cooling circuit 150. Additionally or alternatively, the condenser 148 may be connected to the second storage tank 120. In particular, the condenser may be in thermal communication with the second storage tank 120 to transmit heat to the second liquid volume within the second storage tank 120. For example, the condenser 148 may be in planar contact with a wall of the second storage tank 120 (e.g., with a bottom wall of the second storage tank 120). Alternatively, the condenser 148 may integrally form a wall of the second storage tank 120 (e.g., the bottom wall of the second storage tank 120). In some embodiments, the condenser 148 is disposed within the second storage tank 120 (e.g., enclosed therein).

The expansion device 146 may be provided on the cooling circuit 150 between the evaporator 144 and the condenser 148. The expansion device 146 may be any suitable expansion device, such as, for example, an expansion valve, a capillary tube, or the like. It should be understood that conventional expansion devices are well known in the art, and thus a detailed description thereof will be omitted.

Figure 2:
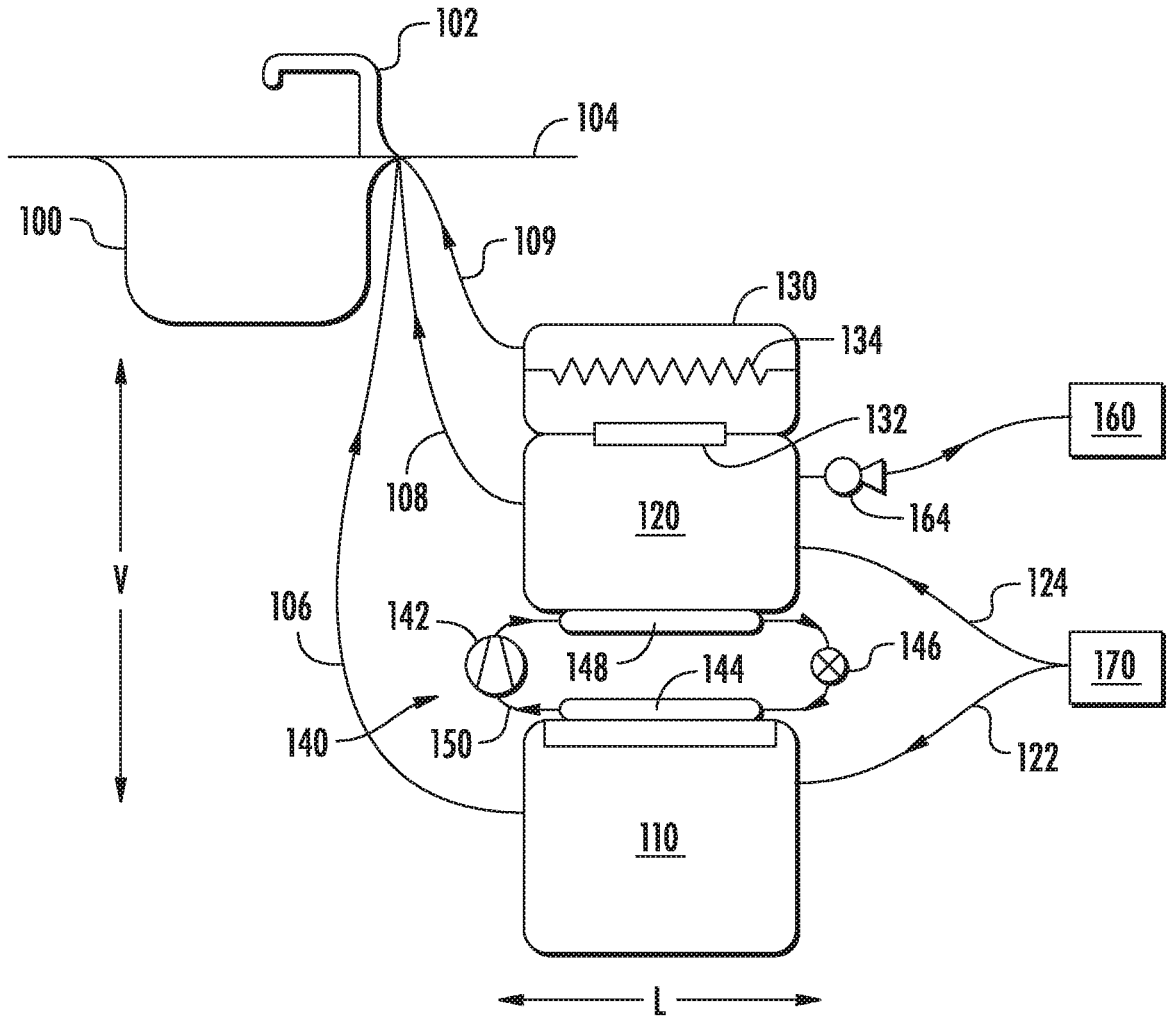
FIG. 2 provides a diagram elevation view of a water dispensing system according to another exemplary embodiment of the present disclosure.

Turning now to FIG. 2, a water dispensing system 10 according to another exemplary embodiment of the present disclosure is shown. As shown, a third storage tank 130 may be mounted below the sink basin 100. In exemplary embodiments, the third storage tank 130 is mounted below the counter 104 or sink basin 100. Additionally or alternatively, the third storage tank 130 may be mounted adjacent to the sink basin 100. The third storage tank 130 may be in fluid parallel with the first storage tank 110. In other words, liquid may be supplied independently to the faucet 102 from the first storage tank 110 and the third storage tank 130. The third storage tank 130 may be in fluid communication with the second storage tank 120. For example, the third storage tank 130 may be mounted directly on the second storage tank 120 (e.g., on top of the second storage tank 120). An inner volume of the third storage tank 130 may be equal to or smaller than an inner volume of the second storage tank 120. In operation, the third storage tank 130 may store water at a temperature higher than a temperature of water stored in the second storage tank 120. The third storage tank 130 may be predominately hexahedral in shape. However, the third storage tank 130 may have any suitable shape capable of storing liquid.

An opening may be provided in the second storage tank 120 and the third storage tank 130 to allow stratification between the second storage tank 120 and the third storage tank 130 (e.g., liquid may pass between the second storage tank 120 and the third storage tank 130). The third storage tank 130 may store a predetermined volume of a third liquid. For example, the third storage tank 130 may store water to be consumed or used by a user. The third storage tank 130 may be provided upstream from the faucet 102.

An auxiliary dispense line 109 may fluidly connect the third storage tank 130 to the faucet 102. Accordingly, a desired amount of the third liquid may be supplied from the third storage tank 130 to the faucet 102 via the auxiliary dispense line 109.

In optional embodiments, the third storage tank 130 includes a heater 134 (e.g., to selectively heat the third liquid). The heater 134 may be provided inside the third storage tank 130 and may directly contact the third liquid. Generally, the heater 134 may be any suitable heater (e.g., electric heating element) to selectively heat the third liquid. For example, the heater 134 may be an electric coil heater (e.g., resistance heating element). Additionally or alternatively, the heater 134 may include or be provided as a radiant heating element, microwave heating element, halogen heating element, etc. The heater 134 may heat the third liquid to a third predetermined temperature above the first and second predetermined temperatures. The third predetermined temperature may be between about 165° F. and about 200° F. In one example, the third predetermined temperature is about 195° F.

A cold water supply 170 may supply ambient temperature water (e.g., tap water) to the first storage tank 110 and the second storage tank 120. The cold water supply 170 may be a conventional water input line (e.g., extending from a domestic or municipal water source). A first supply line 122 may fluidly connect the cold water supply 170 with the first storage tank 110. The first supply line 122 may be a conventional connection hose. In turn, the first supply line 122 may allow ambient or tap water to flow from the cold water supply 170 into the first storage tank 110.

A second supply line 124 may fluidly connect the cold water supply 170 with the second storage tank 120. The second supply line 124 may be a conventional connection hose. In turn, the second supply line 124 may allow ambient or tap water to flow from the cold water supply 170 into the second storage tank 120. As shown, the first supply line 122 and the second supply line 124 may be in fluid parallel. In other words, tap water from the cold water supply 170 may be supplied to the first storage tank 110 via the first supply line 122 and to the second storage tank 120 via the second supply line 124 independently from one another. Additionally or alternatively, tap water may flow simultaneously into the first storage tank 110 via the first supply line 122 and into the second storage tank 120 via the second supply line 124.

Figure 3:
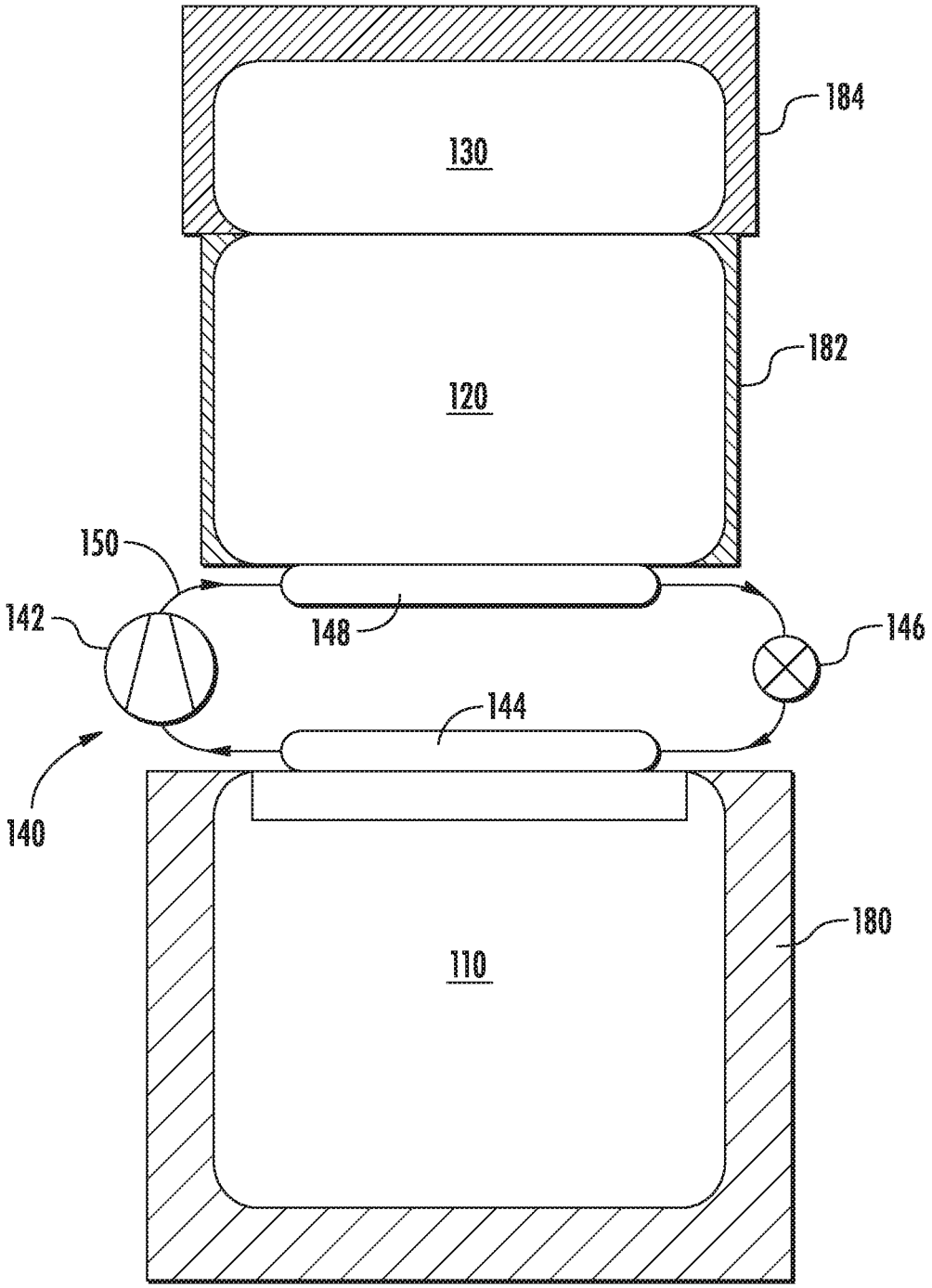
FIG. 3 provides a diagram elevation view of a water dispensing system according to yet another exemplary embodiment of the present disclosure.

Turning now to FIG. 3, a water dispensing system according to yet another exemplary embodiment of the present disclosure is shown. The first storage tank 110 may include an insulation 180. Insulation 180 may be referred to as a first insulation wall 180. Generally, insulation 180 may prevent first storage tank 110 from sweating due to a temperature difference under the sink basin 100. In other words, insulation 180 may prevent condensation from forming on an outside of the first storage tank 110. Insulation 180 may surround or at least partially enclose the first storage tank 110. In one example, insulation 180 is provided on a bottom side, a front side, a back side, a left side, and a right side of the first storage tank 110. Insulation 180 may also be provided on a top side of first storage tank 110. Insulation 180 may also cover the evaporator 144 in some embodiments. Insulation 180 may be a solid panel type insulation. In some embodiments, insulation 180 is a spray foam insulation. Nonetheless, it is understood that insulation 180 may be any suitable insulation for preventing heat transfer between the first storage tank 110 and the ambient air underneath the sink basin 100.

The second storage tank 120 may include an insulation 182. Insulation 182 may be referred to as a second insulation wall 182. Generally, insulation 182 may provide a protective layer around second storage tank 120. Insulation 182 may surround or at least partially enclose the second storage tank 120. In one example, insulation 182 is provided on a front side, a back side, a left side, and a right side of the second storage tank 120. Insulation 182 may also be provided on a bottom side of second storage tank 120. Insulation 182 may also cover the condenser 148 in some embodiments. Insulation 182 may be a solid panel type insulation. In some embodiments, insulation 182 is a spray foam insulation. Nonetheless, it is understood that insulation 182 may be any suitable insulation for preventing heat transfer between the second storage tank 120 and the ambient air underneath the sink basin 100.

The third storage tank 130 may include an insulation 184. Insulation 184 may be referred to as a third insulation wall 184. Generally, insulation 184 may provide a protective layer around third storage tank 130. Insulation 184 may surround or at least partially enclose the third storage tank 130. In one example, insulation 184 is provided on a top side, a front side, a back side, a left side, and a right side of the third storage tank 130. Insulation 184 may also be provided on at least part of a bottom side of third storage tank 130. Insulation 184 may be a solid panel type insulation. In some embodiments, insulation 184 is a spray foam insulation. Nonetheless, it is understood that insulation 184 may be any suitable insulation for preventing heat transfer between the third storage tank 130 and the ambient air underneath the sink basin 100.

In some embodiments, a thickness of insulation 182 around the second storage tank 120 may be less than a thickness of insulation 180 around the first storage tank 110. Alternatively, a thickness of insulation 182 around the second storage tank 120 may be less than a thickness of insulation 184 around the third storage tank 130. The thickness of the insulation may be a depth of the insulation measured from a surface (e.g., outer surface) of a respective storage tank outward (e.g., radially outward or otherwise opposite from the enclosed volume thereof). Additionally or alternatively, the thickness of the insulation may be a density of insulation applied to each respective storage tank. In some embodiments, insulation 182 around the second storage tank 120 may be omitted entirely. In this case, insulation is only provided as insulation 180 around the first storage tank 110 and insulation 184 around the third storage tank 130.

Figure 4:
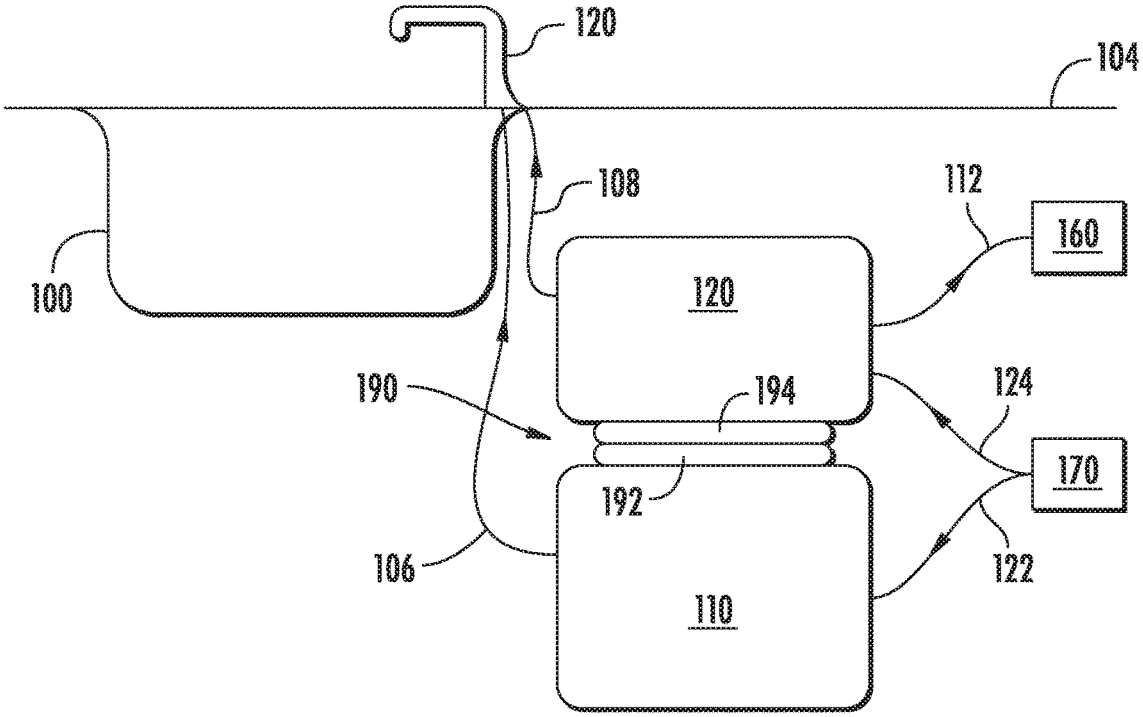
FIG. 4 provides a diagram elevation view of a water dispensing system according to yet another exemplary embodiment of the present disclosure.

FIG. 4 illustrates another exemplary embodiment of a water dispensing system 10. Like features are represented by like reference numerals, and a repeat description of like features will be omitted. According to another exemplary embodiment of a water dispensing system 10 shown in FIG. 4, the first storage tank 110 and the second storage tank 120 may be connected by a thermoelectric module 190. The thermoelectric module 190 may exchange heat between the first liquid in the first storage tank 110 and the second liquid in the second storage tank 120 according to the Peltier effect. The thermoelectric module 190 may include a first thermally conducting plate 192. The first thermally conducting plate 192 may be attached to the first storage tank 110. In one example, the first thermally conducting plate 192 is attached to a top face of the first storage tank 110 (e.g., the first thermally conducting plate 192 is in planar contact with the top face of the first storage tank 110). In another example, the first thermally conducting plate 192 forms at least a portion of the top face of the first storage tank 110. The first thermally conducting plate 192 may remove heat from the first liquid within the first storage tank 110 when (e.g., in response to) an electric current is/being run through the thermoelectric module 190.

The thermoelectric module 190 may include a second thermally conducting plate 194. The second thermally conducting plate 194 may be attached to the second storage tank 120. In one example, the second thermally conducting plate 194 is attached to a bottom face of the second storage tank 120 (e.g., the second thermally conducting plate 194 is in planar contact with the bottom face of the second storage tank 120). In another example, the second thermally conducting plate 194 forms at least a portion of the bottom face of the second storage tank 120. The second thermally conducting plate 194 may transmit heat to the second liquid within the second storage tank 120 when (e.g., in response) an electric current is/being run through the thermoelectric module 190.

Figure 5:
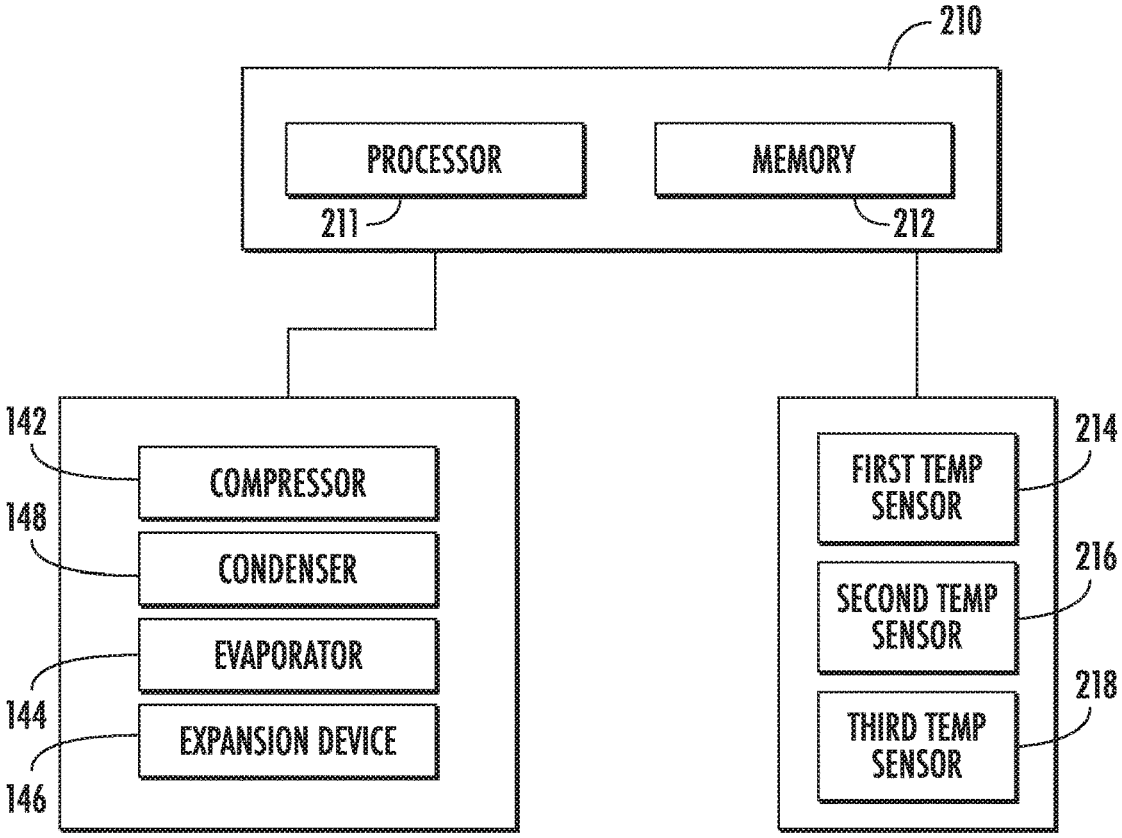
FIG. 5 provides a schematic diagram of a controller according to an exemplary embodiment of the present disclosure.

Turning now to FIG. 5, a water dispensing system 10 (FIGS. 1 through 4) according to an exemplary embodiment may include a controller 210. The controller 210 includes a processor 211 and a memory 212. The controller 210 may be in operative (e.g., electrical or wireless) communication with the vapor compression system 140 and the valve 162. In some such embodiments, the controller 210 is configured to control an operation of the compressor 142, the evaporator 144, the expansion device 146, and the condenser 148 (e.g., according to a set or programmed storage operation).

The first storage tank 110 may include a first temperature sensor 214 (e.g., in operative communication with the controller 210). The first temperature sensor 214 may be any suitable sensor configured to sense a temperature, such as a thermistor, an infrared sensor, or the like. The first temperature sensor 214 may be provided inside the first storage tank 110 and may be configured to measure a temperature of the first liquid within the first storage tank 110. Additionally or alternatively, the first temperature sensor 214 may measure a temperature of the first storage tank 110. In some such embodiments, the first temperature sensor 214 is provided on an outer surface of the first storage tank 110.

The second storage tank 120 may include a second temperature sensor 216 (e.g., in operative communication with the controller 210). The second temperature sensor 216 may be any suitable sensor configured to sense a temperature, such as a thermistor, an infrared sensor, or the like. The second temperature sensor 216 may be provided inside the second storage tank 120 and may be configured to measure a temperature of the second liquid within the second storage tank 120. Additionally or alternatively, the second temperature sensor 216 may measure a temperature of the second storage tank 120. In such embodiments, the second temperature sensor 216 is provided on an outer surface of the second storage tank 120.

The third storage tank 130 may include a third temperature sensor 218 (e.g., in operative communication with the controller 210). The third temperature sensor 218 may be any suitable sensor configured to sense a temperature, such as a thermistor, an infrared sensor, or the like. The third temperature sensor 218 may be provided inside the third storage tank 130 and may be configured to measure a temperature of the third liquid within the third storage tank 130. Additionally or alternatively, the third temperature sensor 218 may measure a temperature of the third storage tank 130. In such embodiments, the third temperature sensor 218 is provided on an outer surface of the third storage tank 130.

During use, the memory 212 may store the temperatures of the first liquid, the second liquid, and the third liquid respectively sensed by the first temperature sensor 214, the second temperature sensor 216, and the third temperature sensor 218. The controller 210 may control an operation of the vapor compression system 140 according to the temperature of the first liquid sensed by the first temperature sensor 214. In one example, when (e.g., in response to) the temperature of the first liquid sensed by the first temperature sensor 214 is/being above a predetermined temperature (e.g., first predetermined temperature), the controller may start an operation of the compressor 142 to drive the vapor compression system 140.

Figure 6:
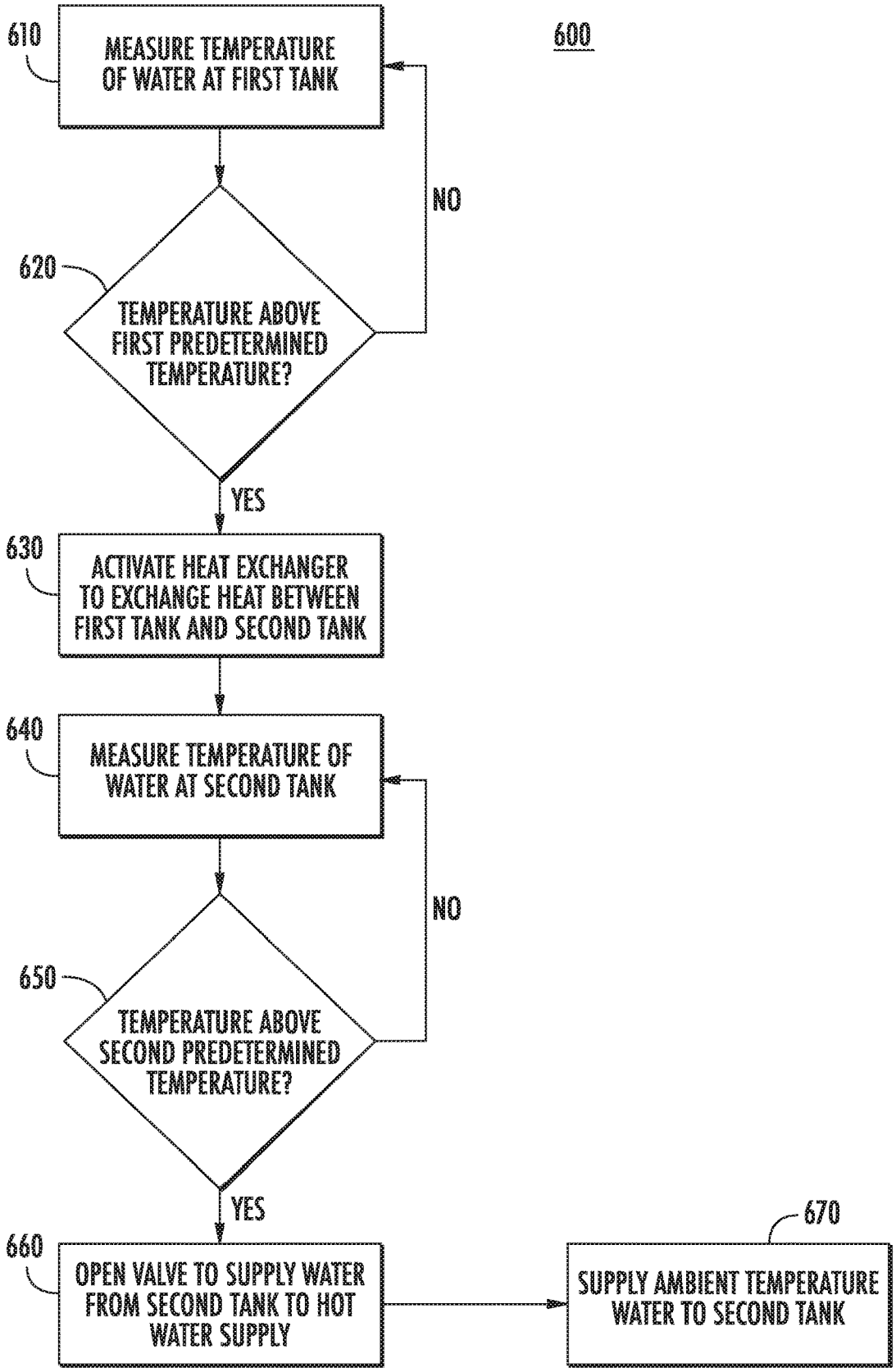
FIG. 6 provides a flow chart illustrating a method of operating a water dispensing system according to an exemplary embodiment of the present disclosure.

Turning now to FIG. 6, a method 600 of operating a water dispensing system 10 will be described (e.g., as or as part of a storage operation). The water dispensing system 10 may be one of the exemplary water dispensing systems described above, and as such, a detailed description will be omitted.

As shown, at 610, the method 600 includes measuring a temperature of water at the first storage tank. For instance, the first temperature sensor may transmit a temperature signal corresponding to a current temperature at the first storage tank. In turn, the controller may receive and read the temperature signal as a measurement of the first liquid in the first storage tank. The temperature of the first liquid may be stored in the memory as a first temperature (e.g., as part of 610).

At 620, the method 600 includes evaluating the determined first temperature. In particular, the determined first temperature may be compared to a first predetermined temperature. Optionally, the first predetermined temperature may be a suitable temperature for drinking or human consumption. In some embodiments, the first predetermined temperature is between about 35° F. and about 45° F. For example, the first predetermined temperature may be about 38° F. If the determined first temperature is not above the first predetermined temperature, the method 600 may return to 610 (e.g., repeat 610 and 620 until a determined first temperature is greater than the first predetermined temperature). In other words, the method 600 may return to 610 in response to the determined first temperature being less than the first predetermined temperature. By contrast, if the determined first temperature is greater than the first predetermined temperature, the method 600 may proceed directly to 630. In other words, the method 600 may proceed to 630 in response to the determined first temperature being greater than the first predetermined temperature.

At 630, the method 600 includes activating a heat exchanger between the first storage tank and the second storage tank. For instance, the heat exchanger may include or be provided as at least a portion of the vapor compression system or the thermoelectric module described above. Accordingly, the controller initiates a heat exchange operation. The heat exchanger may absorb heat from the liquid in the first storage tank and transfer the heat to the liquid in the second storage tank.

At 640, the method 600 includes measuring a temperature of the second liquid within the second storage tank. For instance, the second temperature sensor may transmit a temperature signal corresponding to a current temperature at the second storage tank. In turn, the controller may receive and read the temperature signal as a measurement of the second liquid in the second storage tank. The temperature of the second liquid may be stored in the memory as a second temperature (e.g., as part of 640).

At 650, the method 600 includes evaluating the determined second temperature. In particular, the determined second temperature may be compared to a second predetermined temperature. Optionally, the second predetermined temperature may be a suitable temperature for washing dishes. In some embodiments, the second predetermined temperature is between about 120° F. and about 140° F. For example, the second predetermined temperature may be about 130° F. If the determined second temperature is not above the second predetermined temperature, the method 600 may return to 640 (e.g., repeat 640 and 650 until a determined second temperature is greater than the second predetermined temperature). In other words, the method 600 may return to 640 in response to the determined second temperature being less than the second predetermined temperature. By contrast, if the determined second temperature is greater than the second predetermined temperature, the method 600 may proceed directly to 660. In other words, the method 600 may proceed to 660 in response to the determined second temperature being greater than the second predetermined temperature.

At 660, the method 600 includes opening the valve to supply a portion of the second liquid from the second storage tank to the hot water supply. Alternatively, the method 600 may include activating the pump to pump a portion of the second liquid from the second storage tank to the hot water supply. In some embodiments, both the pump and the valve will be controlled by the controller in order to supply a portion of the second liquid from the second storage tank to the hot water supply.

At 670, the method 600 includes supplying ambient temperature water to the second tank. For instance, the controller may sense how much of the second liquid has been removed from the second storage tank. The controller may then control the cold water supply to supply ambient temperature (e.g., tap) water to the second storage tank. Ambient tap water may be supplied to the second storage tank to a fill point. The method may be repeated as necessary to maintain the first storage tank at or below the first predetermined temperature. The method may be repeated as necessary to maintain the second storage tank at or below the second predetermined temperature.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A water dispensing system, comprising:

a faucet;

a sink basin mounted beneath the faucet downstream therefrom;

a first storage tank mounted below the sink basin to store a first liquid volume upstream from the faucet;

a second storage tank mounted below the sink basin to store a second liquid volume upstream from the faucet in parallel with the first storage tank; and a vapor compression system comprising a compressor spaced apart from the first storage tank and the second storage tank to motivate a refrigerant along a cooling circuit, an evaporator in fluid communication with the compressor along the cooling circuit, the evaporator being connected to the first storage tank in conductive thermal communication to remove heat from the first liquid volume, a condenser in fluid communication with the compressor along the cooling circuit, the condenser being connected to the second storage tank in conductive thermal communication to transmit heat to the second liquid volume, and an expansion device in fluid communication with the compressor along the cooling circuit.

2. The water dispensing system of claim 1, wherein the first storage tank and the second storage tank are connected to a tap water line in parallel to separately receive water from the tap water line.

3. The water dispensing system of claim 1, further comprising:

a return line connecting the second storage tank to a downstream main hot water line; and a valve configured to open and close the return line.

4. The water dispensing system of claim 3, further comprising a pump configured to pump the second liquid volume from the second storage tank into the main hot water line.

5. The water dispensing system of claim 4, further comprising a third storage tank mounted above the second storage tank to store a third liquid volume, the third storage tank being in fluid communication with the second storage tank.

6. The water dispensing system of claim 5, further comprising a heater provided in the third storage tank, the heater being configured to heat the third liquid volume.

7. The water dispensing system of claim 5, further comprising:

a first temperature sensor provided in the first storage tank to measure a temperature of the first liquid volume;

a second temperature sensor provided in the second storage tank to measure a temperature of the second liquid volume;

a third temperature sensor provided in the third storage tank to measure a temperature of the third liquid volume;

and a controller in operative communication with the vapor compression system and the valve, the controller being configured to initiate a maintenance cycle comprising releasing a predetermined amount of the second liquid volume from the second storage tank to the downstream main hot water line via the valve when the second temperature is above 130° F.

8. The water dispensing system of claim 5, further comprising:

a first insulation wall that surrounds the first storage tank;

a second insulation wall that surrounds the second storage tank; and a third insulation wall that surrounds the third storage tank, wherein the second insulation wall is thinner than the first insulation wall and the third insulation wall.

9. A water dispensing system, comprising:

a faucet;

a sink basin mounted beneath the faucet and downstream therefrom;

a first storage tank mounted below the sink basin to store a first liquid volume upstream from the faucet;

a second storage tank mounted below the sink basin to store a second liquid volume upstream from the faucet, the second storage tank being in parallel with the first storage tank;

a thermoelectric module connected between the first storage tank and the second storage tank, the thermoelectric module comprising a first thermally conducting plate attached to the first storage tank to remove heat from the first liquid volume and a second thermally conducting plate attached to the second storage tank to transmit heat to the second liquid volume;

a first dispense line fluidly connecting the first storage tank and the faucet; and a second dispense line fluidly connecting the second storage tank and the faucet.

10. The water dispensing system of claim 9, wherein the first storage tank and the second storage tank are connected to a tap water line in parallel to separately receive water from the tap water line.

11. The water dispensing system of claim 9, further comprising:

a return line connecting the second storage tank to a downstream main hot water line; and a valve configured to open and close the return line.

12. The water dispensing system of claim 11, further comprising a pump configured to pump the second liquid volume from the second storage tank into the downstream main hot water line.

13. The water dispensing system of claim 11, further comprising a third storage tank mounted above the second storage tank to store a third liquid volume, the third storage tank being in fluid communication with the second storage tank.

14. The water dispensing system of claim 13, further comprising a heater provided in the third storage tank, the heater being configured to heat the third liquid.

15. The water dispensing system of claim 13, further comprising:

a first temperature sensor provided in the first storage tank to measure a temperature of the first liquid volume;

a second temperature sensor provided in the second storage tank to measure a temperature of the second liquid volume;

a third temperature sensor provided in the third storage tank to measure a temperature of the third liquid volume;

and a controller in operative communication with the thermoelectric module and the valve, the controller being configured to initiate a maintenance cycle comprising releasing a predetermined amount of the second liquid volume from the second storage tank to the downstream main hot water line via the valve when the second temperature is above 130° F.

16. The water dispensing system of claim 13, further comprising:

a first insulation wall that surrounds the first storage tank;

a second insulation wall that surrounds the second storage tank; and a third insulation wall that surrounds the third storage tank, wherein the second insulation wall is thinner than the first insulation wall and the third insulation wall.

17. A method of storing water within a water dispensing system, the water dispensing system comprising a first storage tank, a second storage tank, a third storage tank mounted above the second storage tank, and a heat exchanger between the first and second storage tanks, wherein the heat exchanger comprises a vapor compression system comprising a compressor, an evaporator, a condenser, and an expansion valve, and wherein the first storage tank, the second storage tank, and the vapor compression system are provided underneath a sink basin, the method comprising:

transferring heat from a first liquid stored in the first storage tank to a second liquid stored in the second storage tank;

measuring a temperature of the second liquid with a temperature sensor;

pumping a portion of the second liquid from the second storage tank into a hot water supply when the temperature of the second liquid is above a predetermined temperature; and supplying ambient temperature liquid to the second storage tank.

18. The method of claim 17, wherein the third storage tank stores a third liquid volume, the third storage tank being in fluid communication with the second storage tank.

19. The method of claim 18, wherein the water dispensing system further comprises:

a first dispense line connecting the first storage tank with a faucet; and a second dispense line connecting the second storage tank with the faucet in parallel with the first dispense line.

* * * * *